United States Patent [19]

Warnest

[11] 4,315,233

[45] Feb. 9, 1982

[54] DEVICE FOR SHIFTING A DOUBLE-THROW CONTACT ARRANGEMENT

[75] Inventor: Albert Warnest, Freudenberg, Fed. Rep. of Germany

[73] Assignee: Siemens Aktiengesellschaft, Munich, Fed. Rep. of Germany

[21] Appl. No.: 134,897

[22] Filed: Mar. 28, 1980

[30] Foreign Application Priority Data

Apr. 11, 1979 [DE] Fed. Rep. of Germany ..... 2914775

[51] Int. Cl.[3] ..... H01H 71/16

[52] U.S. Cl. ..... 337/66; 337/73; 337/86

[58] Field of Search ..... 337/64, 65, 66, 72, 337/73, 74, 70, 86, 95; 335/24

[56] References Cited

U.S. PATENT DOCUMENTS

| | | | |
|---|---|---|---|
| 3,675,177 | 7/1972 | Ellenberger | 337/72 X |
| 3,686,602 | 8/1972 | Jullien-Davin | 337/72 X |
| 3,800,260 | 3/1974 | Woodger | 337/72 X |
| 3,938,065 | 2/1976 | Ellenberger | 335/24 |

*Primary Examiner*—George Harris
*Attorney, Agent, or Firm*—Kenyon & Kenyon

[57] ABSTRACT

A device for shifting a contact arrangement in a thermally operating protective relay having a make contact, a break contact, as well as a double-throw contact, provides for shifting the arrangement from self-locking to automatic resetting by shifting the make contact by means of a piston which can be locked. The self-locking condition provided can be cancelled by arranging the make contact for motion, in the closing direction, by the piston which is supported so as to be freely movable. The plunger has a resilient hook which can snap into undercuts in the housing of the relay which establish the end positions of the plunger. The undercuts are arranged in steps so that two different end positions for the plunger are obtained when the plunger is rotated approximately 90°. One end position corresponds to the automatic resetting of the contact arrangement. The other end position makes it possible to move the plunger to cancel the self-locking condition. Using this structure, only one piston is needed, and the shift can be made with one hand.

5 Claims, 6 Drawing Figures

DEVICE FOR SHIFTING A DOUBLE-THROW CONTACT ARRANGEMENT

BACKGROUND OF THE INVENTION

This invention relates to a device for shifting a contact arrangement for a thermally operated protective relay from self-locking to automatic resetting. More particularly, the invention relates to such a device, having a contact arrangement consisting of a resiliently supported make contact, a break contact, and a double-throw contact, in which the make contact is shifted in the closing direction by means of a piston slide which can be locked and has means for cancelling the self-locking condition. The piston is freely movable and supported against a spring force.

One known device of the above-mentioned type is provided with a plunger which is supported for motion transverse to the travel direction of the resiliently supported make contact and which takes over the shifting and resetting function. In this device, the plunger is locked in the automatic resetting position by a separately provided eccentric. An additional return spring is required for restoring the plunger to the starting position.

In a known thermal overload relay, the shifting is accomplished by pushing the reset button in to the stop and pushing a separately provided slider into the range of motion of the reset button. When the reset button is released, the toggle switch is shifted to manual reset.

SUMMARY OF THE INVENTION

The present invention provides a device of the above-mentioned type which, among other things, allows one-hand shifting, while, at the same time, offering ease of assembly and low manufacturing costs. In the device of the present invention a piston is supported for motion in the direction of resilience of the make contact and can be locked transversely to that direction by rotation to the position for automatic reset. No additional return spring is required for the piston and separate parts for locking the piston in the automatic reset position are not needed. Putting the piston in place is substantially simplified by providing it, in a slot running at least part of its length, with a hook on a spring steel band. The hook establishes the upper end position of the piston in both positions of rotation. Providing the hook on the piston requires little or not extra cost when the piston is made. In order to prevent the device from being shifted unintentionally, the piston is advantageously provided with a screwdriver slot. Then a tool must be used intentionally by a technician in order to make a shift. If the hook rests, under spring tension, against part of the housing wall transverse to the length of the piston in the position of the plunger for automatic reset, a certain amount of torque must be supplied to move the piston so that it is practically impossible for the plunger to get shifted in normal operation. The piston may be held in a predetermined manual reset position with little or no additional initial cost by means of radially extending projections on the piston which, in the position for manual reset (in the unoperated condition of the piston), extend into conforming recesses in a snap-on cover placed over the terminals of the equipment.

DETAILED DESCRIPTION OF THE INVENTION

Figure 1:
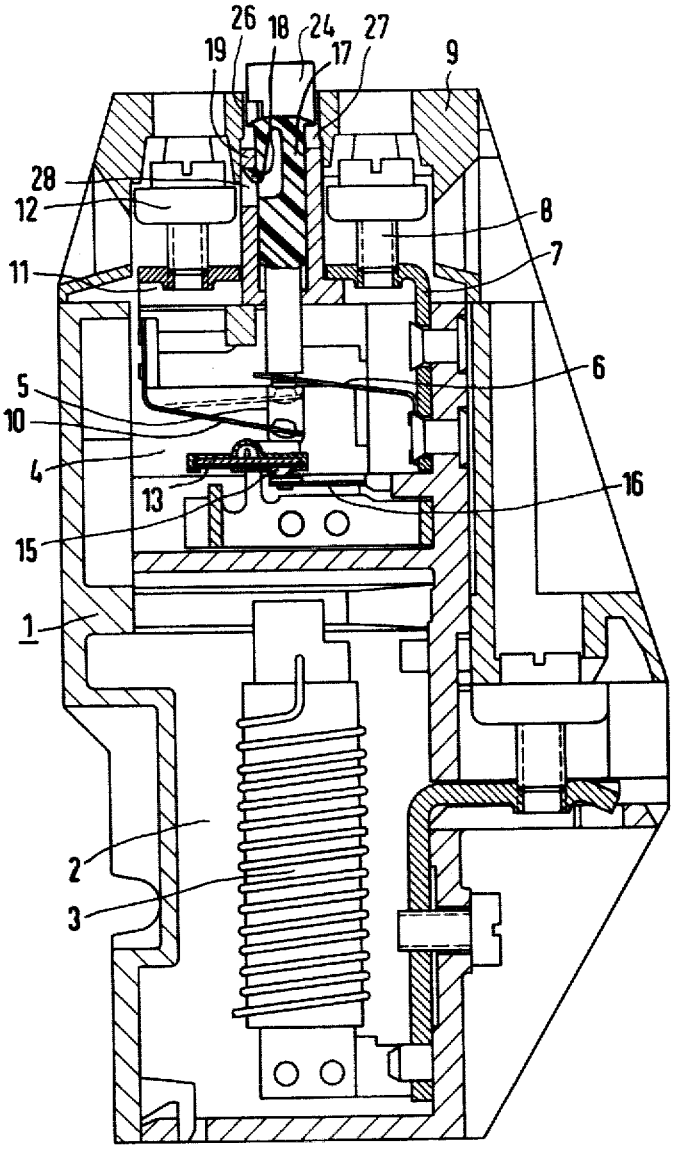
FIG. 1 is a front view, in partial cross-section, of a device for shifting the contact arrangements in a thermally actuated protective relay.
Figure 4:
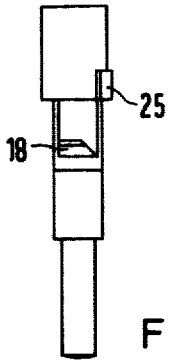
Figure 5:
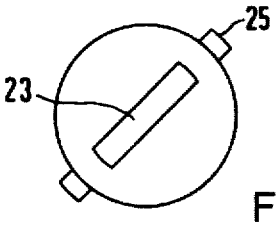
Figure 6:
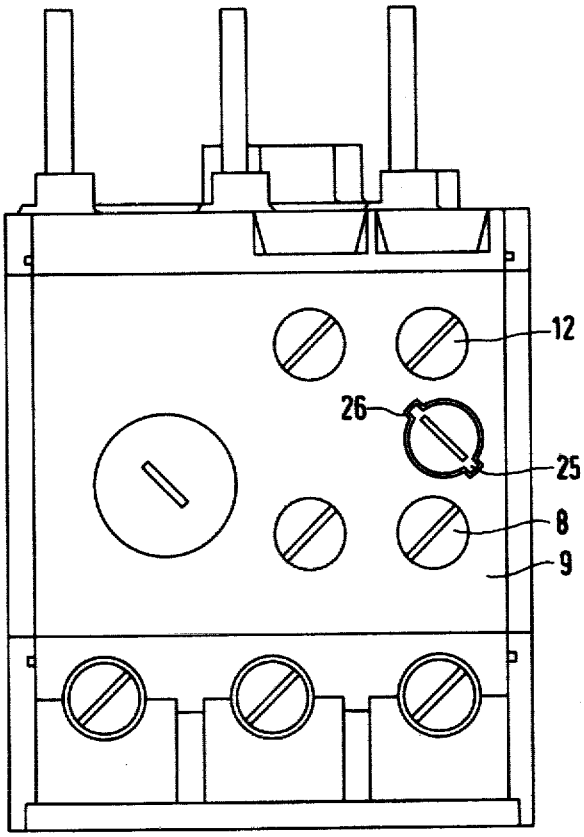
FIG. 6, is a top view onto a complete protective relay.

The thermal protection relay shown in FIG. 1, a so-called bimetal relay, consists of a housing 1, having a base part 2, which contains plural bimetal strips 3, and associated release sliders, not shown in the drawing, which act in a known manner on a contact arrangement 5 mounted in an upper region 4 of the housing. In the illustrative embodiment, contact arrangement 5 includes a make contact 6 carried on a connecting angle bracket 7, having a terminal screw 8. Screw 8 can be held, in its open position, by a cover 9 which is, snapped onto upper part 4 of housing 1. A double-throw contact 10 is brought, by means of a terminal angle 11, to a terminal screw 12 which is also retained by cover 9. In the illustrative embodiment, double-throw contact 10 cooperates with make contact 6 and is acted upon by a plastic-coated rocker 13. Rocker 13 is part of a conventional toggle arrangement which works with a dead-center spring 14. Rocker 13 can also be connected to voltage and for that purpose is provided with a contact 15 which cooperates with fixed break contact 16. Make contact 6 includes a contact spring which acts to bring piston 17, movably supported in housing 1, to rest against a stop 19 of housing 1 by means of a hook 18. Hook 18 is carried on a spring leg 21 (best seen in FIG. 4) carried in a cut-out or slot 20 and extending beyond the contour of the otherwise cylindrical piston or plunger. In addition, the piston has, as shown in FIG. 5, a screw driver slot 23 in its end face. There are also, on the enlarged upper cylindrical part 24, projections 25 which extend into conforming recesses 26 of cover 9 to prevent rotation of plunger 17 when it is in the raised, manual reset position.

Figure 2:
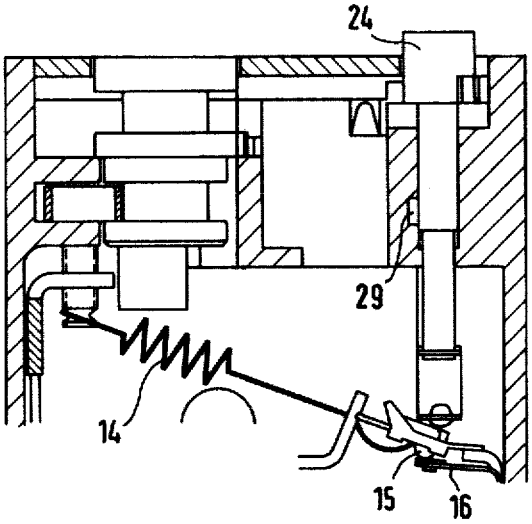
FIG. 2 is a view from the right side, in partial cross-section, of the upper part of the device of FIG. 1.
Figure 3:
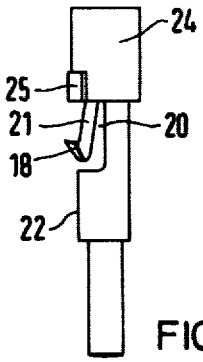
FIGS. 3, 4 and 5 are front, side and top views, respectively, of a piston designed in accordance with the invention.

In operation, the relay is maintained in the manual reset position by hook 18 being seated against the upper surface (step) of recess 28. To place the relay in the automatic reset position, a screwdriver is placed in slot 23 and downwards pressure is applied. When hook 18 is forced out of recess 28 by the pressure of the wall of housing 1, 90° rotation of the screwdriver brings hook 18 into line with recess 29 (FIG. 2), where the hook engages the upper surface (step). By pushing downward again on the piston and reversing the rotation, hook 18 may be freed from recess 29 and restored to the manual reset position.

What is claimed is:

1. In a device for use, in a thermally operated protective relay having a make contact, a break contact, and a double-throw contact, for shifting the contact arrangement from self-locking to automatic resetting by means of a piston which can be locked for shifting the make contact and having means for cancelling the self-locking condition by shifting an elastically resilient make contact in the closing direction by the piston which is supported freely movably against a spring force, the improvement comprising means for movably supporting the piston in the direction of resilience of the make contact and means for rotating the piston to lock it in the position for automatic resetting.

2. In a device in accordance with claim 1 the further improvement comprising the piston having a cutaway portion containing a spring leg carrying a hook which establishes the level of the piston in both positions of rotation.

3. In a device in accordance with claim 2, the further improvement comprising:

a screw driver slot in the piston.

4. In a device in accordance with claim 2, the further improvement comprising:

the hook resting under spring tension, in the position of the piston for automatic reset, against a part of the housing wall which is tranverse to the longitudinal direction of the plunger.

5. In a device in accordance with one of claims 1 to 4, the improvement further comprising the piston having at least one radially extending projection and the housing having a snap-on cover for the terminals of the equipment and at least one recess conforming in outline to the projection(s) for receiving the projections when the piston is in the position for manual resetting.

* * * * *